US008821142B2

(12) United States Patent
Arnold et al.

(10) Patent No.: US 8,821,142 B2
(45) Date of Patent: Sep. 2, 2014

(54) PUMP OR MOTOR FOR LIQUID OR GASEOUS MEDIA HAVING AN INCREASED DIAMETER SHAFT TOWARD A SLANTED SLIDING PLANE

(71) Applicant: Robert Bosch GmbH, Stuttgart (DE)

(72) Inventors: Felix Arnold, Neckarsteinach (DE); Evgenij Skrynski, Leonberg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/863,139

(22) Filed: Apr. 15, 2013

(65) Prior Publication Data

US 2013/0224056 A1 Aug. 29, 2013

(30) Foreign Application Priority Data

Mar. 13, 2007 (DE) ..... 10 2007 012 574
Feb. 18, 2008 (DE) ..... 10 2008 009 694

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 15/06*** | (2006.01) |
| ***F01C 3/08*** | (2006.01) |
| ***F01C 1/08*** | (2006.01) |
| ***F01C 1/00*** | (2006.01) |
| ***F01C 21/18*** | (2006.01) |

(52) U.S. Cl.

CPC ..... *F01C 1/00* (2013.01); *F04C 15/068* (2013.01); *F01C 3/085* (2013.01); *F01C 1/084* (2013.01); *F04C 2240/60* (2013.01); *F01C 21/18* (2013.01)

USPC ..... 418/195; 418/68; 418/102

(58) Field of Classification Search

CPC ..... F04C 3/025; F04C 3/06; F04C 3/08; F04C 9/005; F04C 15/068; F04C 18/54; F04C 18/56; F04C 2240/60; F04C 2240/603; F01C 3/025; F01C 3/06; F01C 3/08; F01C 9/005; F01C 21/18

USPC ..... 418/68, 102, 104, 182, 194, 195

See application file for complete search history.

(56) References Cited

U.S. PATENT DOCUMENTS

| | | | | |
|---|---|---|---|---|
| 2,831,436 | A * | 4/1958 | Schmidt et al. | 418/195 |
| 3,034,445 | A * | 5/1962 | Pelladeau | 418/102 |
| 3,156,222 | A | 11/1964 | Miller, Jr. | |
| 3,236,186 | A * | 2/1966 | Wildhaber | 418/195 |
| 3,856,440 | A | 12/1974 | Wildhaber | |
| 3,895,610 | A | 7/1975 | Wahl | |
| 4,884,957 | A | 12/1989 | Wilimczik | |
| 5,513,969 | A | 5/1996 | Arnold | |
| 7,351,047 | B2 * | 4/2008 | Kawakami et al. | 418/195 |

FOREIGN PATENT DOCUMENTS

| | | |
|---|---|---|
| DE | 4241320 | 6/1993 |
| DE | 19649680 | 4/1997 |
| JP | 11101190 | 4/1999 |
| JP | 2002267033 | 9/2002 |

(Continued)

*Primary Examiner* — Theresa Trieu

(74) *Attorney, Agent, or Firm* — Michael Best & Friedrich LLP

(57) ABSTRACT

A pump or motor for fluid or gaseous media comprising a shaft (4), which faces a working part (13) and has a common inclined sliding surface (14) with the same, whereby the working part (13) limiting the pump working spaces (12) wobbles in a positionally fixed housing (10).

20 Claims, 5 Drawing Sheets

(56) References Cited

FOREIGN PATENT DOCUMENTS

| | | | | | |
|---|---|---|---|---|---|
| JP | 2002364572 | | 12/2002 | | |
| JP | 2007505249 | | 3/2007 | | |
| SU | 220756 | | 6/1968 | | |
| SU | 566024 | | 7/1977 | | |
| WO | 9605436 | | 2/1996 | | |
| WO | WO 2012/034759 | A2 * | 3/2012 | ..... | F04C 15/06 |

* cited by examiner

PUMP OR MOTOR FOR LIQUID OR GASEOUS MEDIA HAVING AN INCREASED DIAMETER SHAFT TOWARD A SLANTED SLIDING PLANE

CROSS-REFERENCE TO RELATED APPLICATIONS

This application is a divisional of co-pending U.S. application Ser. No. 12/531,186 filed on Dec. 31, 2009, which is a national phase application under 35 U.S.C. §371 International Application No. PCT/DE2008/000425 filed on Mar. 13, 2008, which claims priority to German Application No. 102007012574.9 filed on Mar. 13, 2007 and German Application No. 102008009694.6 filed Feb. 18, 2008, the entire contents of all of which are incorporated herein by reference.

BACKGROUND OF THE INVENTION

In a known machine of this type (German published patent application DE-OS 42 41 320), the working part is driven via the shaft, and in the manner like a machine with spur toothing, the working parts between the work faces are reduced or increased in size for pumping the medium. Conversely, such a machine can also act as a motor, in that medium is pumped under pressure into the work chambers and by increasing the size of the work chambers generates a drive of the shaft. In both cases, two working parts in the machine housing are moved to rotate, which makes correspondingly high demands of the rotary bearing and the axial bearing and has a major power limitation with reference to the working pressure.

In another known machine of this type (U.S. Pat. No. 3,236,186), the two parts meshing with their teeth with one another on their face ends are disposed in a housing with a spherical interior, and in the center, a spherical embodiment on the parts makes the tumbling motion of the parts relative to one another that occurs upon rotation possible. Once again, there is a correspondingly major demand made of the rotary bearing of the parts as well as their axial bearing, so that above all narrow limits are set with regard to the magnitude of the working pressure. Moreover, the effort and expense for production of such convex or concave flank faces on the teeth of the spur toothing is extraordinarily high.

In these known pumps or motors, for engineering reasons conduits forming the inlet and outlet to and from the work chambers branch off radially to the working parts, so that once again there is a radial load on the working parts that corresponds to the power pressure. Aside from this, the flow of the medium via the radial peripheries of the edges controlling the orifices of the conduits causes corresponding wear to the working parts, which with a corresponding increase in the power loss over the service life of the machine likewise increases. Because of this wear, increasing on the spherical surface of the teeth, a leak from one work chamber to the next occurs in this outer spherical region of the teeth, and the otherwise advantageous slight overlap of the radial face end of the teeth with the diametrically opposed spherical wall has an especially adverse effect.

SUMMARY OF THE INVENTION

The object of the invention is to develop a pump or a motor for liquid or gaseous media, namely a machine in this respect, with which even substantially higher media working pressures can be managed without adverse effects and which can be produced without major manufacturing expense.

The machine according to the invention has the advantage that with a simple construction and correspondingly low costs, a machine for high working pressures is created, in which advantageously the pressures that in the known machines have a disadvantageous effect because of radial loading are now predominantly diverted into the more easily controlled axial direction. By the stationary disposition of the other work face, diametrically opposite the working part and defining the work chambers, bearing forces for a second working part are also dispensed with, so that only the working part toward the shaft on the slanted sliding plane has a bearing face, and predominantly only the shaft must have an axial bearing and only to a limited extent also a loaded radial bearing, no loaded radial bearing. The tumbling of the working part corresponds to the rotation of the shaft. Because of this tumbling, the work chambers on rotation of the shaft decrease and increase in size in succession, as a result of which the corresponding power of the machine is created. In the known machines, in particular rotary piston machines such as the Wankel engine or an eccentric worm pump, thought is given mostly to a sectional plane, which leads to difficulties in imagining the design according to the invention. It is decisive for the invention that the stationary work face and the work face of the tumbling working part have a good form lock, including with the spherical surfaces, and there is surface constancy with tightness that remains throughout the work, or in other words is independent of the axial position of the working part.

In an advantageous feature of the invention, the center axis of the stationary work face is identical to the axis of rotation of the shaft. As a result, an optimal tumbling drive is attainable.

In an additional feature of the invention, the partly spherical inner wall that receives the tumbling working part changes over into a cylindrical opening in the housing the diameter of which is equivalent to the diameter of the working part. Particularly if the center axis of the stationary work face is coaxial with the shaft, on the one hand there is favorable support of the working part on the static work face, but also a large partly spherical overlapping face, separating the work chambers, between the working part and the housing.

In an additional advantageous feature of the invention, between the working part and the diametrically opposed, non-corotating work face, a common partly spherically embodied bearing surface is centrally present, which likewise serves the purpose of radially defining the pump work chambers. By this means as well, a major overlap dividing the work chambers exists between the spherical bearing surfaces, with corresponding advantages for the efficiency of the machine.

In an additional advantageous feature of the invention, the teeth of the diametrically opposed spur toothing are embodied as a cycloid toothing, with a power part and a blocking part with a cycloidal development of the sliding surface. Intrinsically, such a feature is known (German patent disclosure DE 42 41 320), but in an embodiment in which the work faces diametrically opposite one another each corotate. The advantages of the cycloidal development are preserved, however, if only one work face rotates, as in the invention. The advantages of the cycloidal development per se can be learned from the prior art.

In an additional feature of the invention, inlets/outlets from the pump work chambers branch off as static conduits axially symmetrically from the stationary work face and in a manner uncontrolled by the working part. As a result, a sharp control edge between the tumbling working part and a spherical wall, with corresponding worsening quality and intrinsically unavoidable wear of the control edges, is avoided. However, for some function systems an additional valve control is desired, and therefore in an additional feature of the invention in this respect, controllable valves may be disposed in the static conduits.

In an additional feature of the invention that is advantageous in this respect, as the valves, plate valves, with a mounting part having one outer and one inner ring, and having spring plates disposed between the rings and secured resiliently on one ring thereof, serve as the valves. Such plate valves can be produced extremely favorably and function on the order of a check valve.

In an additional advantageous feature of the invention, the shaft has an increased diameter toward the slanted sliding plane, and corotating conduits acting as an inlet or outlet extend in the step thus formed.

In a feature of the invention that is advantageous in this respect, openings corresponding to the corotating conduits are present in the work face of the working part, which are controlled by the orifices of the conduits in the slanted sliding plane.

In an alternative advantageous feature of the invention, the shaft, for carrying the liquid or gaseous media onward from and to the work chambers, has a connecting conduit extending in the shaft, in order to avoid radial loads on the shaft from the media being pumped, both toward the housing and toward the rotary bearing. Especially when the invention is used as a canned motor, this feature plays a decisive role, since only by radially relieving the bearing forces of the shaft can the working pressure and thus the power range of the machine be increased accordingly.

In a feature of the invention that is advantageous in this respect, openings are present on the bottom of the work chambers, which openings lead to a collection chamber that is present between the slanted sliding plane and the back side of the working part, and the collection chamber is closed radially toward the outside and leads directly to the connecting conduit. As a result, a direct connection between the work chamber and the connecting conduit is attained, with complete relief of radial forces at the shaft.

In an additional feature of the invention in this respect, at the bearing point between the slanted plane of the working part and the shaft, in the region where the medium is carried toward the connecting conduit, there are tapered places in the material, in order that the unilateral accumulation of material from these tapered places in the material that results in the forming of the slanted plane without mass compensation will be compensated for. As a result, the occurrence of unilateral radial forces from unilateral accumulations of material in the region of the slanted plane on the shaft is averted.

Additional advantages and advantageous features of the invention can be learned from the ensuing description, the drawings, and the claims.

BRIEF DESCRIPTION OF THE DRAWINGS

One exemplary embodiment with a variant is shown in the drawings and described in further detail below. Shown are.

DETAILED DESCRIPTION

Figure 1:
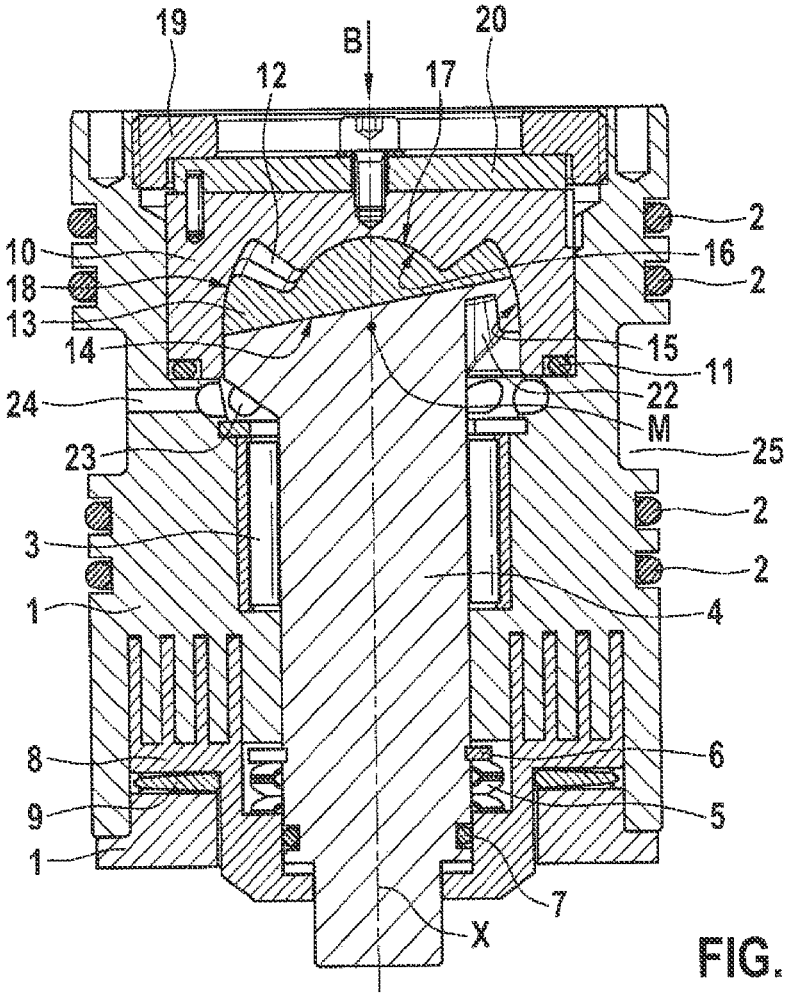
FIG. 1, a longitudinal section along the section line A-A in FIG. 2 of a pump or a motor for liquid or gaseous media.
Figure 3:
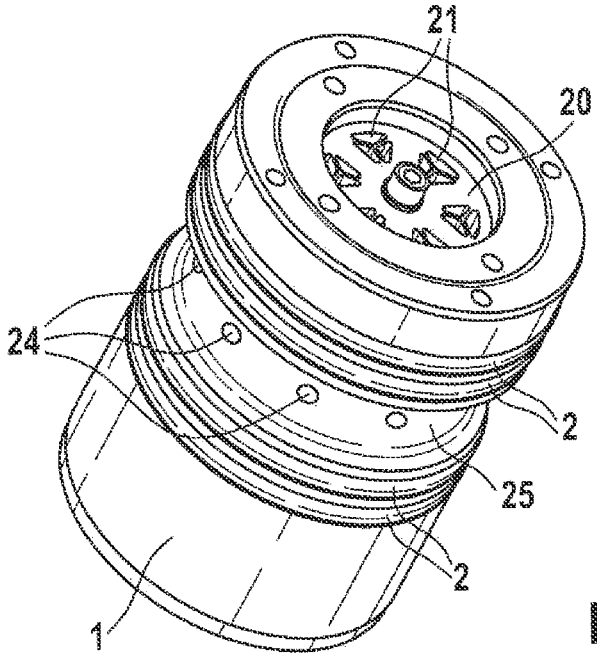
FIG. 3, a perspective view of the machine.

In FIG. 1, an exemplary embodiment of the invention is shown in longitudinal section and is then also shown in perspective in FIG. 3. This is a machine which depending on its use can be used as a pump or motor for liquid or gaseous media, and as can be seen particularly from FIG. 3, the cross section of the mounting housing 1 is cylindrical, to enable inserting the machine into corresponding bores. Toward the bore wall, not shown, O-rings 2 form the requisite sealing off of the mounting housing 1 from the part receiving the machine, such as a pipeline or also a bore in an apparatus that receives this machine. In this mounting housing 1, a shaft 4 is rotatably supported via a radial bearing 3, and via a spring means embodied as a leaf spring 5 and a securing ring 6, the shaft is lightly loaded in the axial direction and is correspondingly displaceable. For sealing purposes, an O-ring 7 is used between the shaft 4 and a housing insert 8; this ring is braced on the mounting housing 1 via an axial bearing 9 and is engaged by the leaf spring means 5. During the rotation of the shaft 4, for reasons of friction as well, the housing insert 8 is carried along with the leaf spring 5 and the O-ring 7, and on its face end remote from the axial bearing 9, the housing insert 8 has a labyrinth as a seal, which partly engages corresponding recesses in the mounting housing.

In the mounting housing 1, a non-corotating work chamber housing 10 is disposed centrally, coaxially with the shaft 4, and is sealed off from the mounting housing 1 via an O-ring 11. This work chamber housing 10 receives a work chamber 12, which is defined on its other side by a rotating working part 13. The shaft 4, on the side toward the working part 13, has a slanted sliding plane 14, so that rotation of the shaft 4 leads to tumbling of the working part 13. The face end, remote from the sliding plane 14, of the working part 13 is toothed in the manner of a cycloid toothing, which correspondingly meshes with a static toothing that is present on the work chamber housing 10, in the opposed wall face of the work chamber 12. Upon rotation of the working part 13 inside this work chamber housing 10 disposed in stationary fashion, the work chambers 12 increase and decrease in size, leading to the desired pumping or motor action, respectively. The teeth, associated with one another, of the working part 13 and the work chamber housing 10 touch in linear fashion toward the respective pump chamber boundary.

To attain guidance in the tumbling motion, the working part 13 is guided in spherical boundaries of the work chamber housing 10 receiving it, namely in a partly spherical surface portion 15, which also radially forms the outer boundary of the work chambers 12, and a central, smaller partly spherical surface portion 16, which defines the work chambers 12 radially inward. Both partly spherical surface portions 15 and 16 have the same center point M. The working part 13, on its side toward the face 16, likewise has a corresponding partly spherical rounded face 17 as well as a partly spherical rounded face 18 corresponding to the partly spherical surface portion 15 having the larger diameter. Because of this spherical overlap, not only is there a very favorable distribution of the axial forces from the shaft 4 to the work chamber housing 10, but there is also an extremely favorable separation from one work chamber to another and from a work chamber to other machine conduits, especially during operation, or in other words during the tumbling of the working part 13.

The work chamber housing 10 is secured in the mounting housing 1 via a threaded ring 19, and a valve plate 20 is fastened between the threaded ring 19 and the work chamber housing 10. In the view B shown in FIG. 2, it is shown how connection conduits 21 for the working medium are disposed in this valve plate 20, centrally-symmetrically about an axis X of the machine, and these conduits lead to the work chambers 12. The axis X is simultaneously the axis of rotation of the shaft 4 and correspondingly passes through the center point M of the spherical faces.

A connection with the work chambers 12 exists via control conduits 22 to an annular chamber 23, surrounding the shaft, for the working medium, and depending on the use, the annular chamber 23 acts as an inlet or outlet conduit. In the exemplary embodiment shown, this annular chamber 23 communicates via radial conduits 24 with an outer annular chamber 25, as can be seen particularly in FIG. 3. When the machine is installed, such an annular chamber 25 is then made to coincide with at least one conduit for the medium.

Figure 2:
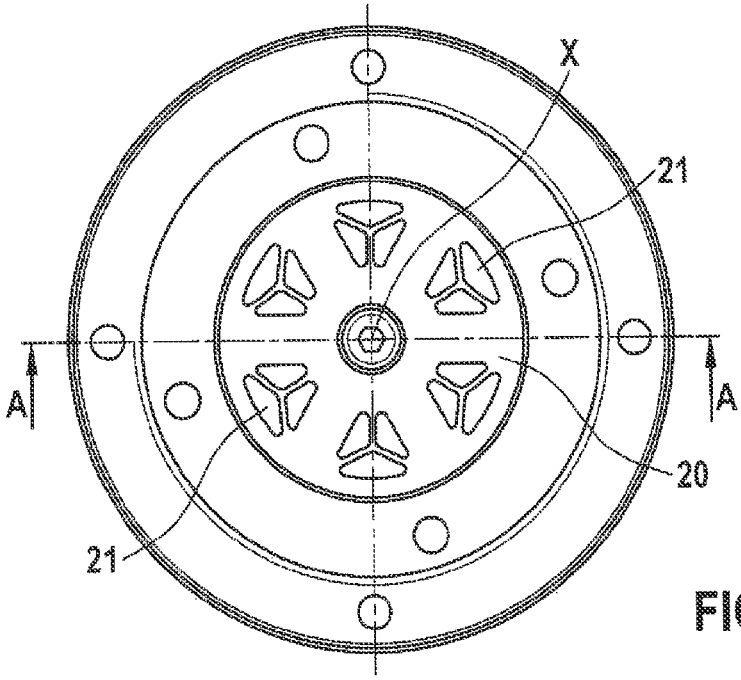
FIG. 2, a view of the machine of FIG. 1 in the direction of the arrow B.
Figure 4:
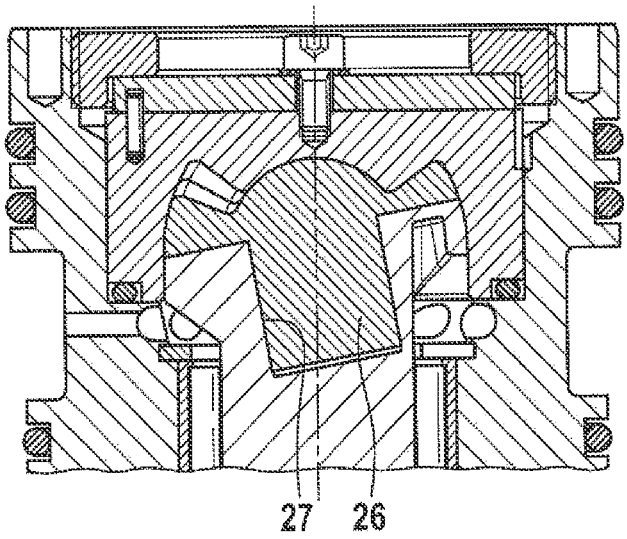
FIG. 4, a longitudinal section through the machine of FIG. 1, having a first variant of the working part.

The first variant of the exemplary embodiment, shown in FIG. 4, has only one peg 26 on the working part, which is inserted into a bore 27 in the shaft, and this peg extends coaxially with the axis of the working part. Otherwise, the machine is constructed exactly like what is shown in FIGS. 1 through 3.

Figure 6:
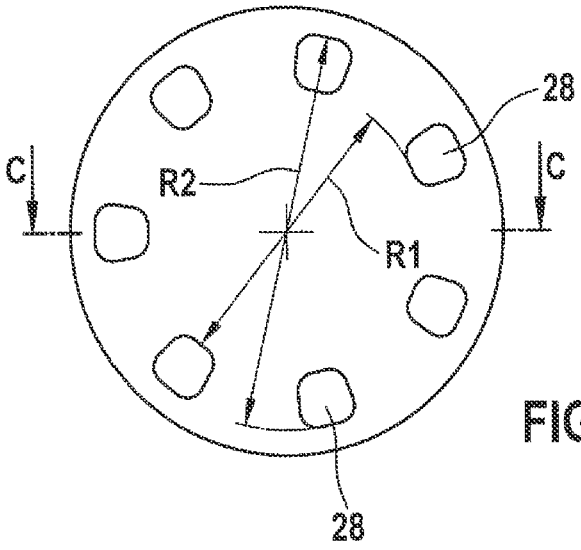
FIG. 6, a view in the direction of the arrow D in FIG. 5.
Figure 5:
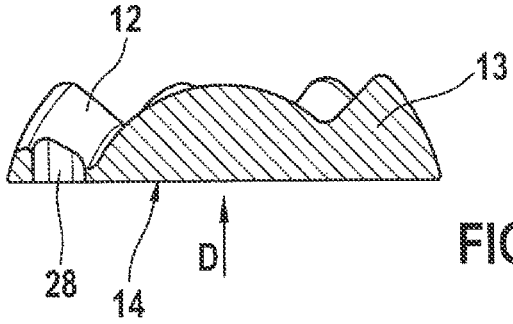
FIG. 5, a longitudinal section through a working part, along the section C-C in FIG. 6.
Figure 7:
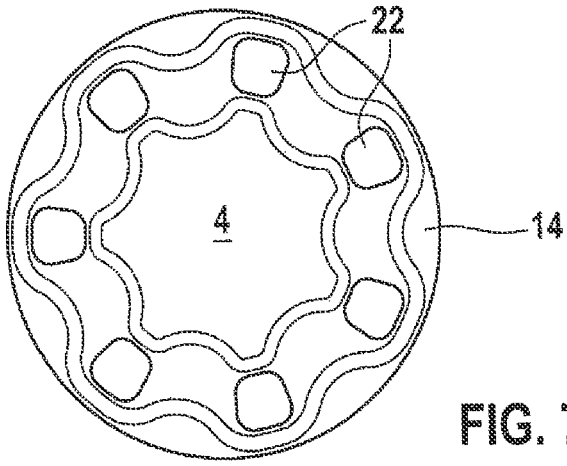
FIG. 7, a top view, diametrically opposite the view D, on the control face of the shaft.
Figure 9:
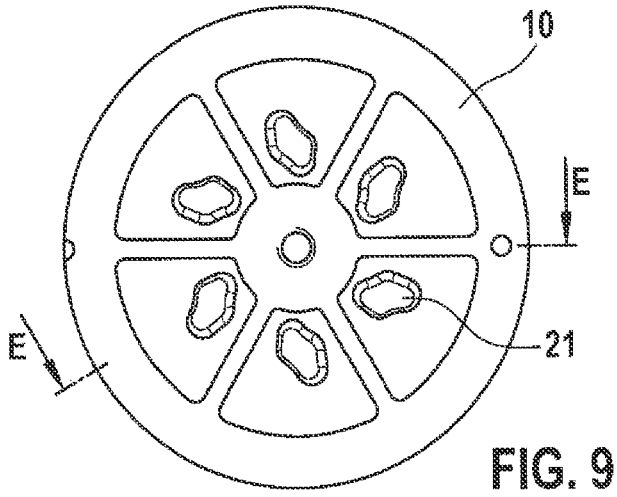
FIG. 9, a view of the pump housing of FIG. 8 in the direction of the arrow F.
Figure 8:
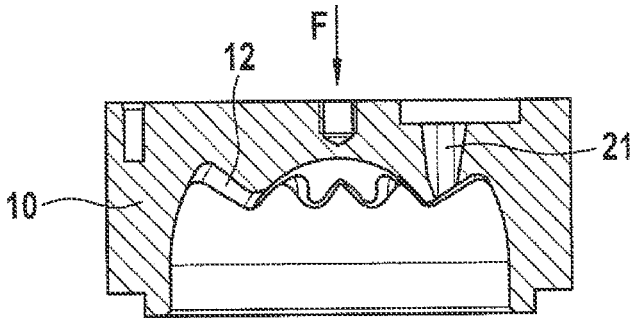
FIG. 8, a longitudinal section through the pump housing along the line E-E in FIG. 9.
Figure 10:
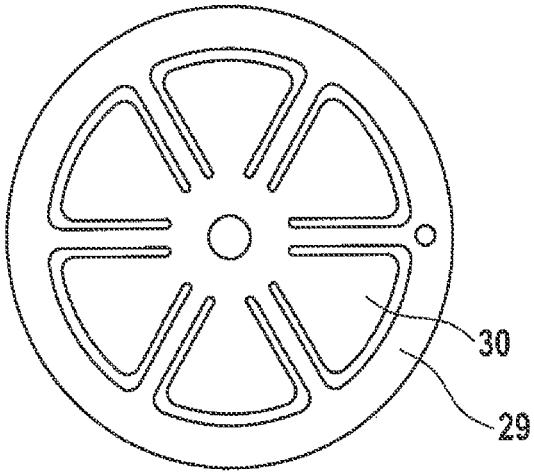
FIG. 10, a top view on a valve plate.
Figure 11:
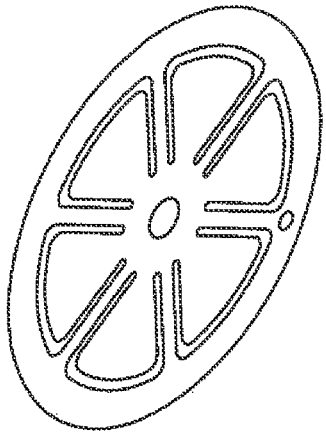
FIG. 11, the valve plate of FIG. 10 in a perspective view.

FIGS. 5 through 7 show the control in the region of the slanted sliding plane 14 in the exemplary embodiment of FIG. 1; the working part 13 has conduits 28, which discharge from the work chambers 12 into the sliding plane 14. These conduits 28 cooperate with the control conduits 22 on the face end, shown in FIG. 7, of the shaft 4 toward the slanted sliding plane 14. On the side toward the slanted sliding plane 14, the shaft 4 has a larger diameter than on its supported portion, so that the control conduits 22 can be disposed in the step thus formed and accordingly for controlling the conduits 28 are located opposite the conduits in the slanted sliding plane 14. As shown in FIG. 6, the diameters R1 and R2 on the boundary circles receiving the conduits 28 are nearly the same diameters as those of the partly spherical surface portions 15 and 16.

In FIGS. 8 through 11, the carrying of the medium from or to the work chambers 12 in the work chamber housing 10 is shown. The connection conduits 21, which lead to and away from the work chambers 12, are covered by the valve plate 20, on which in turn a valve ring 29 with spring plates 30 is disposed, which control the connection conduits 21 in the manner of a check valve. The valve ring 29 includes an outer and inner ring, and the spring plates 30 may be disposed between the rings and secured resiliently on one of the outer or inner rings.

Figure 12:
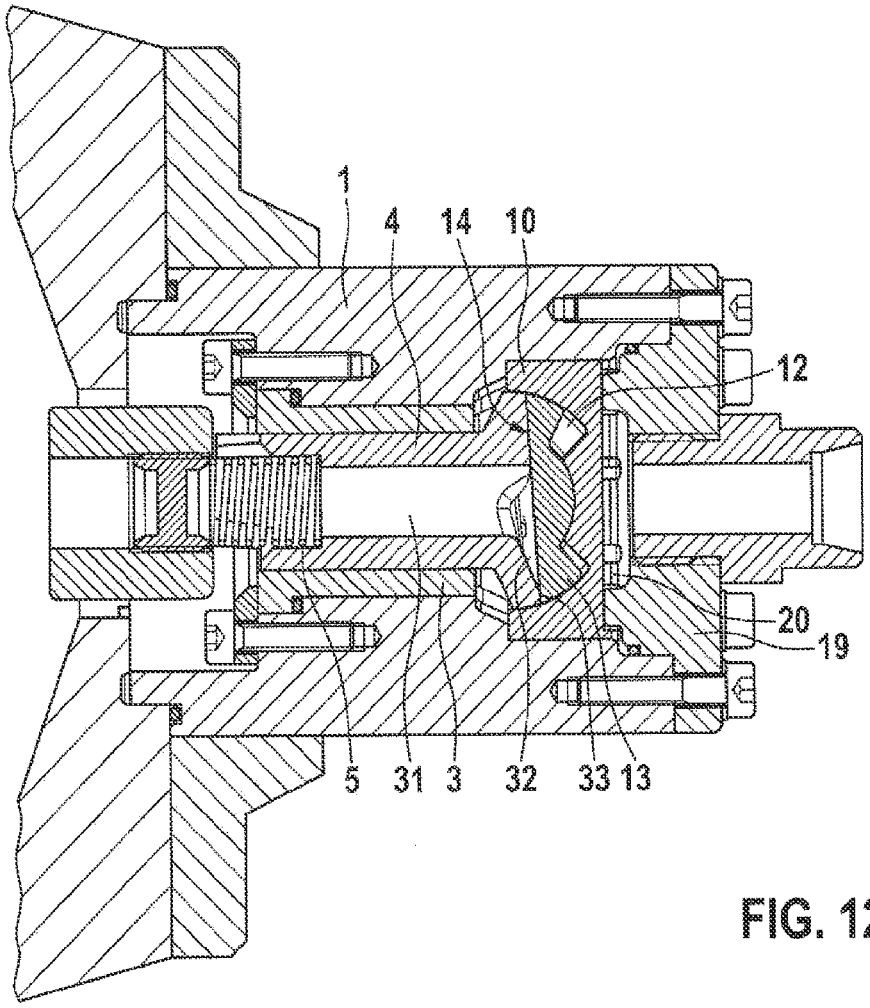
FIG. 12, a second variant of the exemplary embodiment.

In the second variant, shown in FIGS. 12 and 13, the reference numerals of FIGS. 1 through 11 are adopted to the extent that they do correspond and are supplemented as follows. In this variant, the goal above is to prevent any radial forces whatever from engaging the shaft 4. For this reason, instead of leading radially away, the line carrying the medium being pumped is carried centrally through the shaft, specifically through a connecting conduit 31 provided there. For that purpose, a corresponding bore that is coaxial with the axis X is provided in the shaft 4; at its top it communicates with the work chambers 12, specifically via the slanted sliding plane 14, and on the other end it can advantageously receive the spring means, now embodied as a spiral spring 5, which is furthermore easily adjustable in its initial tension.

Figure 13:
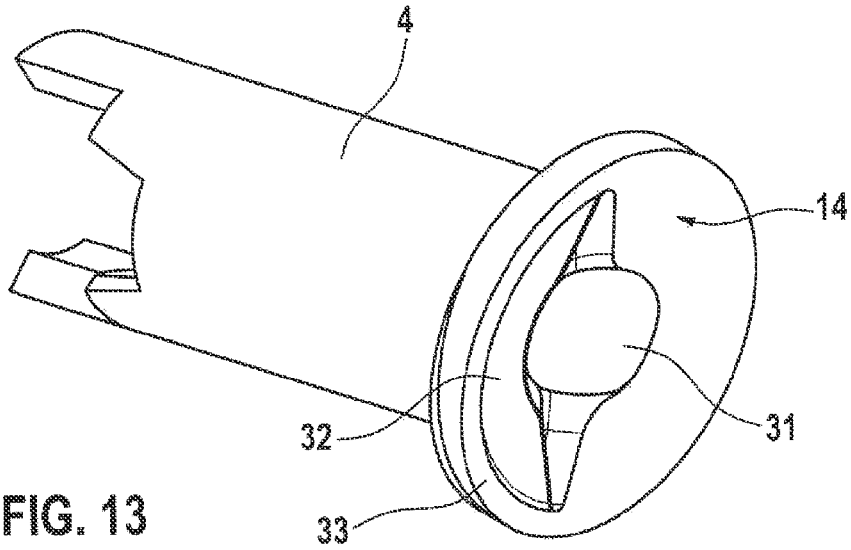
FIG. 13, the shaft of that variant in a perspective view.

As can be seen from FIG. 13, as a consequence of the slanted sliding plane 14 the accumulation of material at the top of the shaft 4 and particularly in the control region would be unilateral, so that unilateral radial forces would also occur. Therefore according to the invention, a recess 32 is provided in the control region at the top, so that as a result, mass compensation and thus unilateral radial forces are avoided. Because of a remaining radial portion 33 of the slanted sliding plane, the medium flowing via openings 22 provided in the bottom of the working part 13 is prevented from flowing into unwanted regions, above all between the top of the shaft 4 and the work chamber housing 10. Naturally, for connecting the conduits 28 (FIG. 5), disposed in the bottom of the working part 13, with the slanted sliding plane a radially outer indentation, creating a recess for the flowing medium, may be provided either in the working part 13 or in the slanted sliding plane 14, oriented toward it, of the shaft 4.

The foregoing relates to the preferred exemplary embodiments of the invention, it being understood that other variants and embodiments thereof are possible within the spirit and scope of the invention, the latter being defined by the appended claims.

1 Mounting housing
2 O-ring
3 Radial bearing
4 Shaft
5 Leaf spring means
6 Securing ring
7 O-ring
8 Housing insert
9 Axial bearing
10 Work chamber housing
11 O-ring
12 Work chamber
13 Working part
14 Slanted sliding plane
15 Partly spherical surface portion
16 Partly spherical surface portion
17 Partly spherical rounded face
18 Partly spherical rounded face
19 Threaded ring
20 Valve plate
21 Connection conduits
22 Control conduits
23 Annular chamber
24 Radial conduits
25 Outer annular chamber
26 Peg
27 Bore
28 Conduits
29 Valve ring
30 Spring plate
31 Connecting conduit
32 Recess
33 Radial portion

The invention claimed is:

1. A pump or motor for liquid or gaseous media, comprising:

work chambers disposed between two diametrically opposed work faces that are symmetrical to respective axes of rotation of the two work faces;

one spur toothing on each of the two work faces, the spur toothings associated with one another and which, together with radially extending meshing lines of contact, define the work chambers;

a defined corresponding angle between the respective axes of the two work faces, a working part having a spur toothing for receiving one of the work faces, the working part being rotatable about an axis;

a spherical radial boundary of the working part and of the work faces for sealing support on a partly spherical inner wall of a housing;

a radial boundary of the work chambers, by which boundary the partly spherical inner wall surrounds the working part, on which wall the working part tumbles about the axis and is supported radially sealingly on the wall;

a rotary drive or power takeoff via a shaft; and one conduit forming one inlet and one conduit forming one outlet to the work chambers for the media, wherein between the shaft and the working part a slanted sliding plane is disposed, so that rotation of the shaft leads to tumbling of the working part, and tumbling of the working part leads to rotation of the shaft, the work face, diametrically opposite the working part and having a spur toothing corresponding to the spur toothing of the working part, is non-corotating and is a stationary work face in the housing, and the shaft has an increased diameter toward the slanted sliding plane and the shaft has a connecting conduit, extending in the shaft for carrying the liquid or gaseous media onward from and to the work chambers, wherein the connecting conduit opens out with a recess into the slanted sliding plane, wherein openings are present in the work face of the working part and are controlled by the recess in the slanted sliding plane.

2. The pump or motor as defined by claim 1, wherein a center axis of the stationary work face is identical to the axis of rotation of the shaft.

3. The pump or motor as defined by claim 2, wherein the partly spherical inner wall that receives the tumbling working part changes over into a cylindrical opening in the housing the diameter of which is equivalent to the diameter of the working part.

4. The pump or motor as defined by claim 2, wherein the pump or motor has cylindrical outer dimensions for installation in bores or pipelines.

5. The pump or motor as defined by claim 1, wherein the partly spherical inner wall that receives the tumbling working part changes over into a cylindrical opening in the housing the diameter of which is equivalent to the diameter of the working part.

6. The pump or motor as defined by claim 1, wherein the pump or motor has cylindrical outer dimensions for installation in bores or pipelines.

7. The pump or motor as defined by claim 1, wherein a peg is disposed between the working part and the shaft on the slanted sliding plane and engages a corresponding guide bore of the diametrically opposed part of the working part or the shaft.

8. The pump or motor as defined by claim 7, wherein the peg (26) is disposed on the working part.

9. The pump or motor as defined by claim 1, wherein the shaft including the working part is loaded resiliently in the direction of the stationary work face; and the shaft is supported in a total housing rotatably and axially displaceably.

10. The pump or motor as defined by claim 1, wherein between the working part and the diametrically opposed, non-corotating work face, a common spherically embodied bearing surface is centrally present, which radially defines the pump work chambers.

11. The pump or motor as defined by claim 1, wherein the teeth of the diametrically opposed spur toothing are embodied as a cycloid toothing, with a power part and a blocking part with a cycloidal development of a sliding surface.

12. The pump or motor as defined by claim 1, wherein inlets/outlets from the pump work chambers, as static conduits, branch off axially symmetrically from the stationary work face and in a manner uncontrolled by the working part.

13. The pump or motor as defined by claim 12, wherein the static conduits are controllable by valves disposed in the work chamber housing.

14. The pump or motor as defined by claim 1, wherein for carrying the liquid or gaseous media onward from and to the work chambers, the shaft has a connecting conduit, extending in the shaft, in order to avoid radial loads of the shaft to the housing receiving the shaft or to a bearing for the shaft.

15. The pump or motor as defined by claim 14, wherein openings are present on the bottom of the work chambers, which openings lead to a collection chamber that is present between the slanted sliding plane and a back side of the working part, and the collection chamber is closed radially toward the outside and leads directly to the connecting conduit.

16. The pump or motor as defined by claim 15, wherein in a bearing point between the working part and the slanted sliding plane of the shaft, in a region where the media is carried toward the connecting conduit, there are tapered places in the material for mass compensation pertaining to rotary forces.

17. The pump or motor as defined by claim 14, wherein in a bearing point between the working part and the slanted sliding plane of the shaft, in a region where the media is carried toward the connecting conduit, there are tapered places in the material for mass compensation pertaining to rotary forces.

18. A pump or motor for liquid or gaseous media, comprising:

work chambers disposed between two diametrically opposed work faces that are symmetrical to respective axes of rotation of the two work faces;

one spur toothing on each of the two work faces, the spur toothings associated with one another and which, together with radially extending meshing lines of contact, define the work chambers;

a defined corresponding angle between the respective axes of the two work faces, a working part having a spur toothing for receiving one of the work faces, the working part being rotatable about an axis;

a spherical radial boundary of the working part and of the work faces for sealing support on a partly spherical inner wall of a housing;

a radial boundary of the work chambers, by which boundary the partly spherical inner wall surrounds the working part, on which wall the working part tumbles about the axis and is supported radially sealingly on the wall;

a rotary drive or power takeoff via a shaft; and one conduit forming one inlet and one conduit forming one outlet to the work chambers for the media, wherein between the shaft and the working part a slanted sliding plane is disposed, so that rotation of the shaft leads to tumbling of the working part, and tumbling of the working part leads to rotation of the shaft, the work face, diametrically opposite the working part and having a spur toothing corresponding to the spur toothing of the working part, is non-corotating and is a stationary work face in the housing, wherein the conduits are controllable by valves disposed in the work chamber housing, and wherein plate valves, with a mounting part having one outer and one inner ring, and having spring plates disposed between the rings and secured resiliently on one of the outer ring and the inner ring, serve as the valves.

19. A pump or motor for liquid or gaseous media, comprising:

work chambers disposed between two diametrically opposed work faces that are symmetrical to respective axes of rotation of the two work faces;

one spur toothing on each of the two work faces, the spur toothings associated with one another and which, together with radially extending meshing lines of contact, define the work chambers;

a defined corresponding angle between the respective axes of the two work faces, a working part having a spur toothing for receiving one of the work faces, the working part being rotatable about an axis;

a spherical radial boundary of the working part and of the work faces for sealing support on a partly spherical inner wall of a housing;

a radial boundary of the work chambers, by which boundary the partly spherical inner wall surrounds the working part, on which wall the working part tumbles about its axis and is supported radially sealingly on the wall;

a rotary drive or power takeoff via a shaft; and one conduit forming one inlet and one conduit forming one outlet to the work chambers for the media, wherein between the shaft and the working part a slanted sliding plane is disposed so that rotation of the shaft leads to tumbling of the working part, and tumbling of the working part leads to rotation of the shaft, the work face, diametrically opposite the working part and having a spur toothing corresponding to the spur toothing of the working part, is non-corotating and is a stationary work face in the housing, the shaft has an increased diameter toward the slanted sliding plane forming a step; and corotating conduits acting as an inlet or outlet extend in the step thus formed.

20. The pump or motor as defined by claim 19, wherein openings corresponding to the conduits are present in the work face of the working part and are controlled by the orifices of the conduits in the slanted sliding plane.

* * * * *

UNITED STATES PATENT AND TRADEMARK OFFICE

CERTIFICATE OF CORRECTION

PATENT NO. : 8,821,142 B2
APPLICATION NO. : 13/863139
DATED : September 2, 2014
INVENTOR(S) : Felix Arnold et al.

It is certified that error appears in the above-identified patent and that said Letters Patent is hereby corrected as shown below:

On the title page, item (62) please include the following:

"Related U.S. Application Data
Division of application No. 12/531,186, filed Dec. 31, 2009."

Signed and Sealed this
Twenty-fifth Day of November, 2014

Michelle K. Lee

Michelle K. Lee
*Deputy Director of the United States Patent and Trademark Office*